United States Patent [19]

Morooka et al.

[11] 4,063,076

[45] Dec. 13, 1977

[54] METHOD OF AUTOMATIC WIDTH CONTROL OF HOT ROLLED STRIPS

[75] Inventors: Yasuo Morooka; Shinya Tanifuji, both of Hitachi, Japan

[73] Assignee: Hitachi, Ltd., Japan

[21] Appl. No.: 751,053

[22] Filed: Dec. 16, 1976

[30] Foreign Application Priority Data

Dec. 26, 1975 Japan ..... 50-154969
Jan. 7, 1976 Japan ..... 51-826

[51] Int. Cl.[2] ..... B21B 37/10

[52] U.S. Cl. ..... 364/472; 72/13; 364/118; 364/121

[58] Field of Search ..... 72/13; 235/151.1

[56] References Cited

U.S. PATENT DOCUMENTS 3,670,542 6/1972 Kemppinen et al. ..... 72/8

3,940,598 2/1976 Sekiguchi ..... 235/151.1

*Primary Examiner*—Eugene G. Botz
*Attorney, Agent, or Firm*—Craig & Antonelli

[57] ABSTRACT

This invention relates generically to an automatic strip width control method in a hot rolling mill. More specifically, the present invention relates to a method for controlling a strip width to a predetermined width in a rolling mill equipped with edging rolls which seeks the deviation of strip width by estimating the temperature of a roll material under the edging rolls and controls the roll gap of the edging mill by means of the deviation of strip width thus estimated in order to control the width of the strip to a predetermined level on the basis of the technical conception that there is a certain relation between the temperature of the roll material and the deviation of strip width.

17 Claims, 9 Drawing Figures

STRIP TEMPERATURE
Toe (°C)
1100
1050
1000
head end
tail end
head end
tail end
head end
tail end
head end
tail end
STRIP I
STRIP II
STRIP III
STRIP IV
3.7 sec
(a)
(b)
(c)
(d)
TIME
DEVIATION OF STRIP
WIDTH abe (mm)
12
8
4
0
3.7 sec
STRIP I
STRIP II
STRIP III
STRIP IV
TIME ( sec )

METHOD OF AUTOMATIC WIDTH CONTROL OF HOT ROLLED STRIPS

BACKGROUND OF THE INVENTION

1. Field of the Invention

The present invention relates to a control method of a strip width in a hot rolling mill, especially by controlling the roll gap of a edging mill. The present invention contemplates to adjust the position of the edging rolls and thus to control the strip width by estimating the temperature of a roll material below the edging rolls in accordance with any of the following methods;

1. estimation from a rolling load of the edging rolls;
2. estimation from a rolling load of the horizontal rolls; and
3. estimation from a measured value of a temperature detector disposed on the entry side of the edging rolls.

2. Description of the Prior Art

Rolling in a hot strip mill is generally carried out by the steps of rolling a slab having a thickness of 100–300 mm and width of 500–2000 mm into a rough strip of a thickness of 20–50 mm using the tandem roughing mills or reversing roughers aligned in series, and thereafter rolling the transfer gauge strip into a hot strip of a thickness of about 1.0–12.5 mm using a tandem finishing train.

In this case, as far as the thickness of the strip is concerned, control is effected using an A.G.C. device (Automatic Gauge Control device) so as to ensure the accuracy of thickness. As for the width of the strip which also is one of the most important factors determining the quality of a product, control has not practically been made as accurately as in the thickness control.

As a matter of fact, the strip width control is made usually in the roughing mill equipped with the edging mills partly because it is almost impossible to make the strip width control in a finish rolling mill and partly because spreading of the strip width hardly takes place when a width-thickness ratio of the strip becomes large.

As the method for controlling the strip width by the use of the edging rolls, there have generally been employed the following two methods.

According to the first method, a width measuring instrument is disposed on the rolling line so that a signal on the basis of the measured value from the instrument is fed back as a control signal to control the roll gap of the edging rolls, thereby controlling the strip width.

The second method controls the tension between the rolling mills on the basis of the measured value obtained by the above mentioned measuring instrument in order to control the strip width.

However, the first method encounters the difficulty how to control the width of a slab as the roll material to a desired width on the exit side of the final rougher by adjusting properly a number of factors involved such as a thickness and width of the slab, a rolling temperature, a rolling reduction of the horizontal rolls, and the like.

On the other hand, the second method sets a looper tension or changes a rolling speed in accordance with a signal from the width measuring instrument disposed on the exit side of the final rolling mill so as to control the strip width. When hot rolling is carried out by means of the tension control, however, rolling must be made with a small tension value. That is to say, if the tension value is too large, the rolling mill causes breakages. If it is too small, on the other hand, buckling or the formation of loops tends to occur. For this reason there is an inherent problem with this method in that the tension value can not be varied over a wide range optionally.

According to the second method, further, change in tension affects not only the width but also the thickness of the strip, and is closely and mutually related with the fluctuation of tension between the rolling mills due to the vertical movement of reducing screws in response to the A.G.C., change in the rolling speed of the rolling mills, and so forth. This naturally renders the controlling method further complicated.

BRIEF SUMMARY OF THE INVENTION

The object of the present invention is to control the width of a roll material or a strip in a hot rolling mill having edging rolls by way of controlling the roll gap of the edging rolls.

Another object of the present invention is to obtain a predetermined strip width by way of controlling the roll position of the edging mill on the basis of a temperature of the roll meaterial under the edging rolls.

As means for accomplishing the above mentioned objects, the present invention is characterized in that a temperature of a roll material under the edging rolls is estimated from the relationship between a rolling load applied to the edging rolls and the temperature of the roll material, and the roll gap of the edging rolls is controlled so as to control the strip width by means of the relationship between the estimated temperature and a deviation of strip width.

It is also the characterizing feature of the present invention that the temperature of the roll material under the edging rolls is estimated either from a rolling load of the horizontal rolls or from a thermometer disposed on the entry side of the edging rolls, and positioning of the edging rolls is controlled on the basis of the strip temperature thus estimated in order to maintain the strip width to a predetermined width.

Still another feature of the present invention is to approximate linearly the relation between the temperature of the roll material and the deviation of strip width and to control the roll gap of the edging rolls in accordance with deviation values of strip width based on this approximation in order to control the strip width to a predetermined width.

It is still another feature of the present invention that the temperature of roll material is expressed in terms of a periodic function related with a skid mark and a rolling speed calculated from a rolling load of the horizontal rolls for the purpose of estimation of the temperature of the roll material under the edging rolls, and the gap of the edging rolls is controlled on the basis of the estimation thus obtained.

DESCRIPTION OF THE PREFERRED EMBODIMENTS

Detailed Description of Invention

The present invention is primarily directed to solve the aforementioned problems with the conventional methods and contemplates to control the gap of the edging rolls in response to change in temperatures of the roll material so as to regulate the strip width to a predetermined level.

Deviation of strip width in a hot roughing mill mostly arises from differences in spreading phenomena which take place during the rolling operation using horizontal rolls. The spreading phenomenon tends to become larger especially at those portions where the temperature of the roll material is low such as, for example, at the skid mark.

Our experiences in the practical operation have revealed that the change of 50° C. in the roll material, i.e. a strip, sometimes results in the change of about 10 mm in the strip width. Incidentally, our attempt to compensate this change in the strip width by way of the tension control has resulted in the compensation of the strip width of only about 2–3 mm by the tension change of 40 tons. Thus, the present inventors have found it extremely difficult in practice to compensate the width spread at the skid mark section only through the tension control.

For the above mentioned reason, the inventors of this invention have paid their specific attention to the possibility of the strip width control by controlling the roll gap of the edging mill, in relation to the temperature of the roll material or the strip.

Next, explanation is given on the measuring method of the roll material. Though the present invention calls for the temperature of the roll material under the edging rolls, it is extremely difficult to measure this strip temperature directly. Hence, the present invention has to inevitably resort to other factors for the estimation of the strip temperature. As the method for the estimation that may be used in the present invention, mention can be made of the following methods.

The first method detects a rolling load of the edger roll at the time of rolling so as to estimate the temperature of the strip (roll material) under the edging rolls.

The second method detects a rolling load of the horizontal rolls at the time of rolling so as to estimate the temperature of the strip under the edging rolls.

According to the third method, a temperature detector of the strip is disposed on the entry side of the edging rolls, of which measured value is then used for the estimation of the temperature of the strip under the edging rolls.

Figure 1:
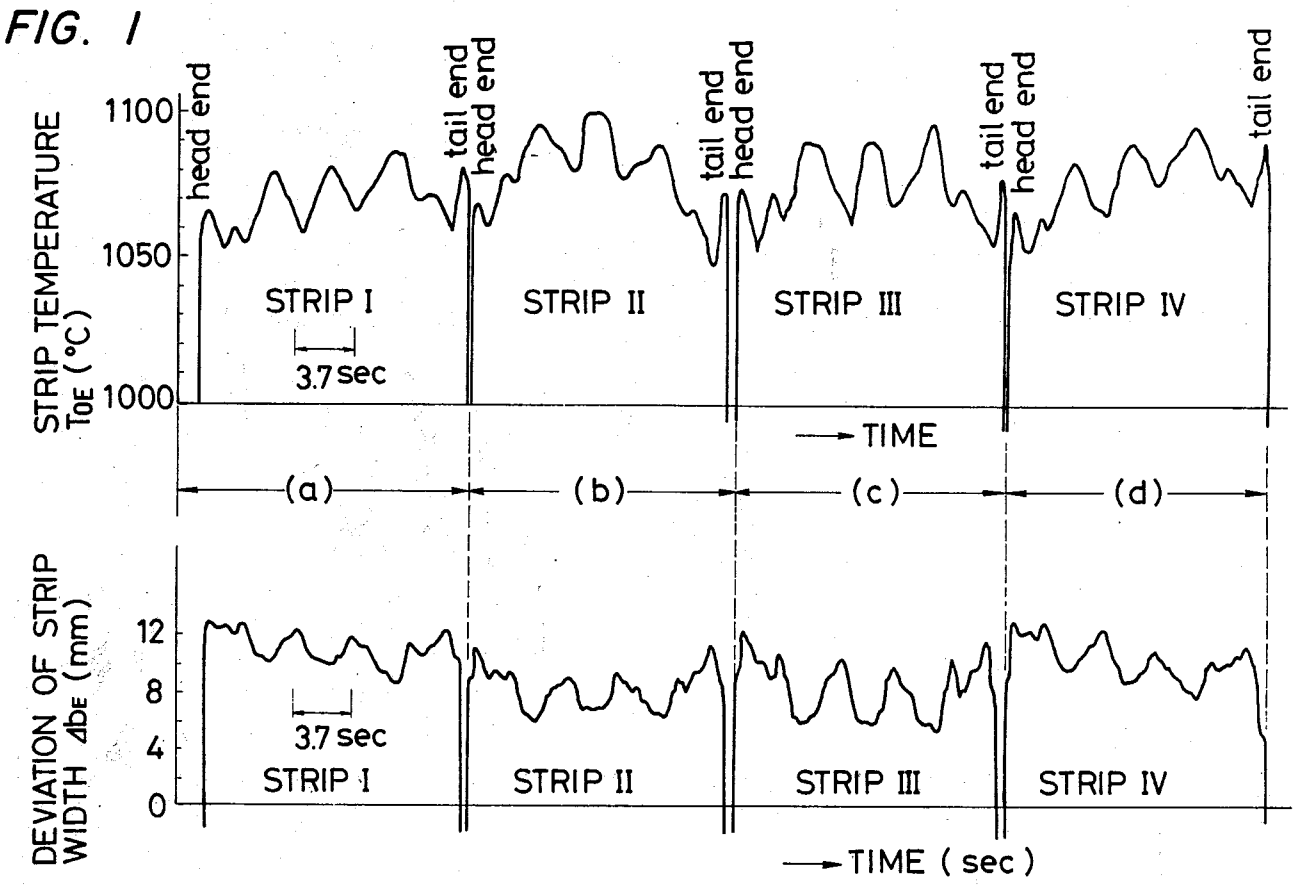
FIG. 1 illustrates data obtained by actual measurements covering the relationship between temperatures of a roll material in edging rolls and the deviation of strip width corresponding to each strip temperature.

Detailed explanation is given initially on the first of the above mentioned methods. It has been confirmed that when rolling is carried out while setting the position of the edging rolls to a certain fixed value, there is obtained the relationship as shown in FIG. 1 by plotting the actual measurement values of the strip temperatures and the deviation of strip width on a same time axis. The measurement is made by juxtaposing a thermometer for detection of the radiant heat and width detector on the exit side of the horizontal rolls so as to determine the relation between the deviation of strip width and the strip temperature.

In FIG. 1, the time zone (*a*) illustrates the relation between the temperature $T_{oE}$ of the strip I and the deviation of strip width $_{\Delta}b_E$ measured in the above mentioned manner. The time zones (*b*), (*c*) and (*d*) similarly illustrate the relation between the strip temperature of the strips II, III and IV and the deviation of strip width, respectively. These values are obtained by carrying out the measurements sequentially after the above mentioned strip I is measured.

Referring to the relation between the strip temperature $T_{oE}$ and the deviation of strip width $\Delta b_E$ shown in FIG. 1, it can be noted that the deviation of strip width decreases as the strip temperature increases, and the former shows the increase when the latter shows the decrease, on the contrary. This relation holds true and such to the strips II through IV as can be seen clearly from FIG. 1.

Figure 2:
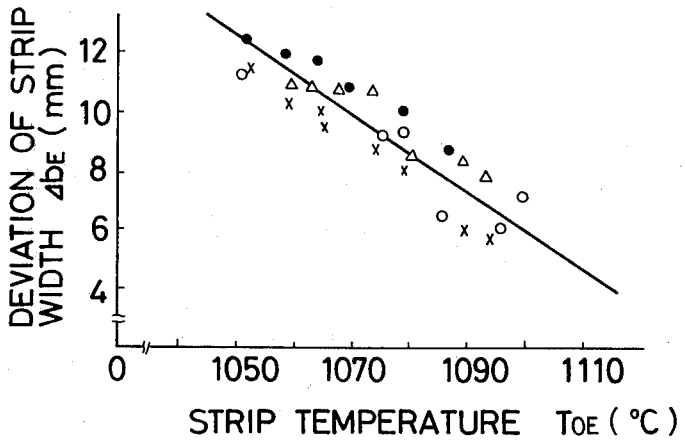
FIG. 2 is a chart obtaind by plotting the relationship between the temperature of the roll material and the deviation value of the strip width shown in FIG. 1.

FIG. 2 illustrates the relation between the strip temperature and the deviation of strip width by plotting the data of FIG. 1. The marks, ● , O, X and Δ indicate the strips I through IV, respectively.

Figure 3:
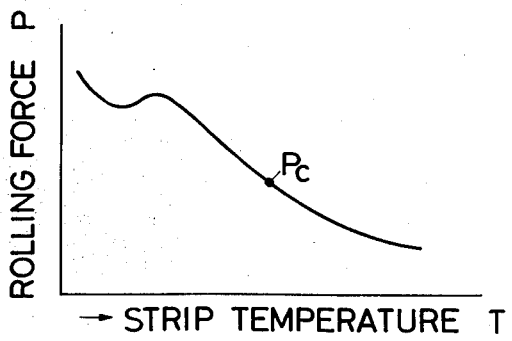
FIG. 3 is a chart showing the relationship between temperatures of the roll material and rolling force.

According to FIG. 2, it will be seen that the strip temperature is nearly inversely proportional to the deviation of the strip width. Therefore, if the temperature of the strip is known, it is possible to guess the deviation of the strip width after it is rolled in the horizontal direction. Basically, the present invention is to control the width of the strip utilizing the relation between the strip temperature and the deviation of the strip width, by using a rolling load that is exerted on the edger rolling mill as a means of recognizing the temperature of the strip. It is widely known that there is a relation between the rolling force and the temperature as shown in FIG. 3 (for example, see "The Theory of Rolling and its Applications", page 112, published by The Iron and Steel Institution of Japan). Hence, if the rolling force (rolling load) is detected, the temperature of the strip can be known from the relation of FIG. 3, from which it is also possible to find the change of temperature of the strip, enabling to guess, from the relation of FIG. 2, the deviation of the strip width inclusive of the spreading caused by the rolling in the horizontal direction.

Next, as for the aforesaid second method, the relation between the strip temperature and the deviation of the strip width is as shown by FIG. 1 and FIG. 2, just in the same manner as mentioned with reference to the aforesaid first method. It will also be understood without needing any particular illustration that the relation is as shown in FIG. 3 between the output signals of a load meter (for example, a load cell) which detects the rolling load at the time of horizontal rolling and the temperature of the strip. In the case of the second method, however, the load is detected in the direction of horizontal rolling, and the change of load under the edging rolls is not detected. But as will be apparent from FIG. 1, the period of strip temperature variation and the period of variation in the deviation of strip width are in agreement, establishing a relatively regular variation; it is, therefore, possible to guess the strip temperature under the edging rolls (guessing the temperature will be mentioned later).

With reference to the aforesaid third method, the temperature of the strip is measured by way of a thermometer, for example, a radiation pyrometer that is provided on the inlet side of the vertical roll, to guess the strip temperature under the edging rolls by correcting the guess the strip temperature under the edging rolls by correcting the time taking into consideration the distance between the position of placing the thermometer and the edging rolls or by correcting the temperature drop before the strip reaches the edging rolls. With the abovesaid third method which enables the strip temperature to be measured most easily, however, it is required to provide a temperature detector separately as well as to effect some correction by taking into consideration the temperature in the strip, as this method measures the temperature on the surface of the strip.

Now, as the temperature of the strip under the edging rolls is guessed by way of the above method, the rolling load enables the temperature to be guessed even though the temperature of the strip is not measured directly, because there are an inversely proportional relation between the strip temperature and the deviation of the strip width as shown in FIGS. 1 and 2, as well as a relation of FIG. 3 between the strip temperature and the rolling force. From the so guessed temperature is then found the deviation of the strip width; the opening degree of the edging rolls is controlled responsive to the deviation to materialize the control of a certain strip width. Even with the aforesaid third method in which the strip temperature is measured to guess the temperature under the vertical roll, the opening degree of the edging rolls can be controlled, of course, using the relation of FIG. 2.

Concrete embodiments of the present invention are mentioned below inclusive of the aforesaid method of guessing the strip temperature.

Mode of Operation of the Invention

Below is first mentioned an example of controlling the strip width by guessing the strip temperature under the edging rolls from the measured rolling force of the edging rolls.

If now the rolling load when the head end of the strip is rolled by the edging rolls is denoted by P*o*, and the rolling load of the subsequent rolling by P, the deviation of the strip temperature ΔT given by the relation (1), $$\Delta T = K\cdot(P - Po) \tag{1}$$

where $K$ is a function of P*o*.

If, for example, the relation near the rolling load P*c* of FIG. 3 is approximated by the relation (2), the function K will be given by the relation (3), $$T = \frac{k_c}{k_a + k_b \cdot P} \tag{2}$$

$$K = \left(\frac{\delta T}{\delta P}\right) = \frac{k_c \cdot k_b}{(k_a + k_b \cdot Pc)^2} \tag{3}$$

-continued $$P = Pc$$

where $k_a$, $k_b$ and $k_c$ are constants determined by the kinds of steels and drafting quantity. (P*c* takes a value over the range that can be approximated by the relation (2), and the non-linear characteristic between P and T is approximated by the relation (2)).

If the temperature deviation is found from the relation (1), the deviation of width Δ*b* from the head end of the strip after rolled horizontally, i.e., the spreading caused by the horizontal rolling is given approximately by the relation (4), $$\Delta b = -m_b\cdot\Delta T + k_T \tag{4}$$

where $k_T$ is a constant.

Therefore, the opening degree (width of the outlet side) of the edging rolls should be controlled to a value proportional to the deviation of width found by the relation (4) above. On the other hand, if the opening degree of the edging rolls is denoted by $S_E$, and the mill rigidity by M, the amount of changing the opening degree $\Delta S_E$ to change the width on the outlet side of the edging rolls by Δ*b*, will be found by the following relation, $$\Delta S_E = -\Delta b - \frac{P - Po}{M} \tag{5}$$

If the relations (1) and (4) are introduced into the relation (5), the resulting relation will be expressed as (6), $$\Delta S_E = \left(m \cdot K - \frac{1}{M}\right)(P - Po) \tag{6}$$

Figure 4:
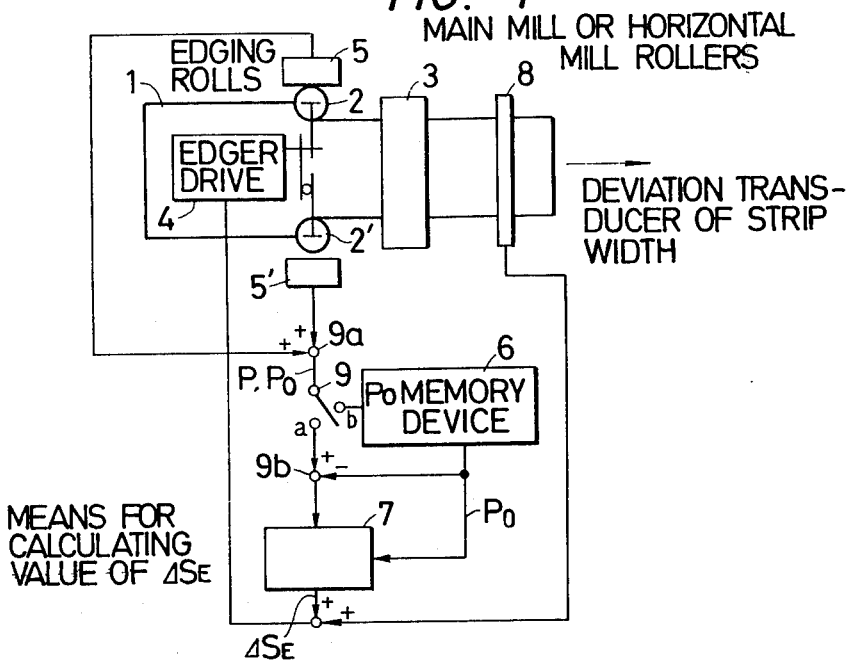
FIG. 4 illustrates an embodiment of this invention for controlling the gap of the edging rolls by estimating the temperature of the roll material from the load of edging rolls.

The present invention is to control the width of the strips based on the aforementioned principle. Though the rolling load when the head end of the strip was rolled by the edging rolls was denoted by P*o*, a reference load may also be denoted by P*o*. In the following embodiments, the load at the time of rolling the head end is denoted by P*o*. FIG. 4 is a block diagram to illustrate an embodiment of the present invention.

Figure 5:
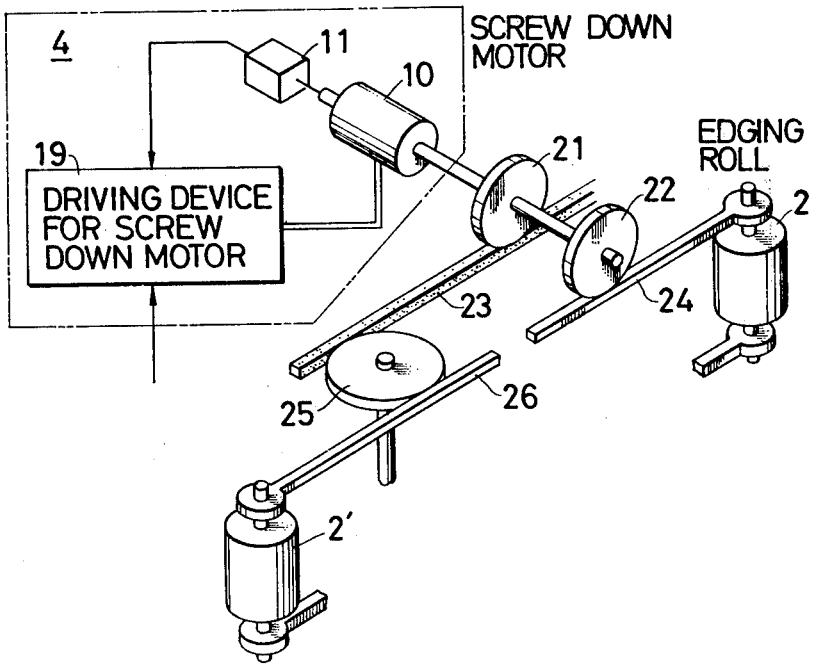
FIG. 5 illustrates an embodiment of a method for controlling the gap of the edging rolls.

With reference to FIG. 4, the strip 1 is rolled in the direction of its width by way of the edging rolls 2, 2' and then rolled by a horizontal or main mill roll 3; on the outlet side is provided a deviation transducer of strip width 8. If now the strip 1 is rolled by the edging rolls, the load at that moment is detected by load detectors 5, 5'. An average P*o* of the detected values by the two detectors is found at an adder unit 9*a*. A switch 9 renders a memory device 6 to store the rolling load P*o* at the head end of the strip, only when the load P*o* is detected via a contact *a*. As the rolling load P*o* is memorized by the memory device 6, the switch 9 feeds the signal of load P to an operation unit 7 (means for calculating value of $\Delta S_E$) via a contact *b*. In a subtraction unit 9*b*, on the other hand, the difference (P − P*o*) between the load P and the signal P*o* from the memory device 6 is calculated, and the calculated result is fed to the operation unit 7. The operation unit 7 performs the operation of relation (6) in relation to K found by the relation (3). The operation unit 7 produces an output signal $\Delta S_E$ which controls the opening degree of the edging rolls 2 by way of a screw-down device 4. The screw-down device consists, for example, as shown in FIG. 5, of a driving device for screw-down motor 19, screw-down motor 10, and speed detector 11. To the rotary shaft of the screw-down motor 10 are directly connected two pinions 21 and 22 with which are engaged reciprocating racks 23 and 24. To the rack 24 is directly connected one roll of a pair of edging rolls 2, 2', and the other rack is connected via a pinion 25 to the rack 26 that is coupled to the other roll of said pair of edging rolls 2, 2'. By way of the above construction the right and left edging rolls are moved by equal amount at equal speed simultaneously. The amounts of moment are each one-half of the output value of the operation unit 7, and the screw-down motor 10 is kept turned until the output of the operation unit 7 fed to the driving device for screw-down motor 19 becomes equal to the integrated value of the output signals of the speed detector 11, whereby the opening degree of the edging rolls 2, 2' is controlled.

Owing to the abovesaid control, the width at the outlet of the edging rolls will be narrow when the strip temperature is low and the width will be wider when the temperature is high. After rolled by way of the horizontal rolls, the width will be constant irrespective of the strip temperature. But the width may often differ from the object width due to errors in control. Therefore, the output of the operation unit 7 is corrected by the output of the deviation transducer of strip width 8 that is installed on the outlet side of the horizontal rolls, so that the strip width will finally reach the object value.

As will be apparent from the foregoing description, in this embodiment, the load by the edging rolls is detected to guess the strip temperature, and the screw-down position of the edging rolls is controlled depending upon the quantity of the change. The controlling quantity of the screw-down position is equal to the sum of the quantity which is proportional to the guessed value of spreading caused by the horizontal rolling and the milling stretch of the edging rolls. If there are no horizontal rolls in the downstream of the edging mill, there is no need of guessing the spreading and whereby the term m will be zero in the relations (4) and (6).

Below is illustrated another embodiment in which the strip temperature under the edging rolls is guessed from the change of load of the horizontal rolls at the time of horizontal rolling, and the opening degree of the edging rolls is controlled utilizing the relation of FIG. 2 between the strip temperature and the deviation of the strip width.

The load by the horizontal rolls is detected and denoted by $P_A$. The relation between the load and the strip temperature is shown by FIG. 3, and hence, the strip temperature $T_R$ under the horizontal rolls is found by the relation (7) using the approximateion of relation (2).

$$T_R = \frac{k'_c}{k'_a + k'_b \cdot P_A} \tag{7}$$

where $k'_a$, $k'_b$, and $k'_c$ are constants determined by the kinds of steels and drafting amount.

The change of strip temperature shown in FIG. 1 can be expressed as the change of temperature with lapse of time $T(t)$, $$T(t) = Ta + Tb \sin(\omega t + \phi) \tag{8}$$

If now the sampling period is set at $\tau$, and the guessed temperature under the horizontal are denoted by $T_R$, $R_{R_1}$ and $T_{R_2}$ at time $t_o$, $t_o - \tau$, and $t_o - 2\tau$, the strip temperature $Ta$ under the horizontal rolls given the the relation (8) can then be expressed as (9), $$Ta = T_R - \frac{T_R - T_{R_1}}{2} \cdot \frac{\sin(\omega t_o + \Phi)}{\cos(\omega t_o - \frac{\omega \tau}{2} + \Phi)\sin\frac{\omega \tau}{2}} \tag{9}$$

Further, $Tb$ and $\phi$ of the relation (8) are given by the following relations, $$Tb = \frac{T_R - T_{R_1}}{2\cos(\omega t_o - \frac{\omega \tau}{2} + )\sin\frac{\omega \tau}{2}} \tag{10}$$

$$\Phi = \tan^{-1}\left[\frac{(T_{R_1} - T_{R_2})\cos(\omega t_o - \frac{\omega \tau}{2})}{(T_R - T_{R_1})\sin(\omega t_o - \frac{3\omega \tau}{2})} \; \frac{-(T_R - T_{R_1})\cos(\omega t_o - \frac{3\omega \tau}{2})}{-(T_{R_2} - T_{R_2})\sin(\omega t_o - \frac{\omega \tau}{2})}\right] \tag{11}$$

From the skid length L and the reference rolling speed $V_R$ that have been known beforehand, the angular frequency $\omega$ is found by the following relation (12), $$\omega = \frac{V_R}{L} \tag{12}$$

By introducing the relations (9) to (12) to the relation (8), and introducing $t_1$ found by the relation (13), $$t_1 = t_o \pm \frac{l}{v} \tag{13}$$

from the distance $l$ between the edging rolls and the horizontal rolls and the rolling speed $v$ at that moment, the strip temperature $T_E$ under the edging rolls can be guessed from the relation (14), $$T_E = Ta + Tb \sin(\omega t_1 + \phi) \tag{14}$$

Referring to the relation (13), the sign + stands for the case in which the horizontal rolls are placed downstream of the edging rolls, and the sign − stands for the case in which the horizontal rolls are placed upperstream of the edging rolls. In these cases, the sampling time $t_o$ may be $t_o = 0$.

Next, the relatiòn between the strip temperature under the edging rolls guessed by the relation (14) and the deviation of the strip width, is as shown in FIG. 2. Therefore, by applying the approximation of the relation (4), the deviation of the strip width $\Delta b_R$ is given by $$\Delta b_R = -m \cdot \Delta T_E + k'_T \tag{15}$$

where $k'_T$ is a constant.

Therefore, the opening degree correcting value $S_E$ of the edging rolls is expressed as, $$\Delta S_E = -\Delta b_R = +m(T_E - T_{Eo}) \tag{16}$$

Here, $T_{Eo}$ represents the temperature when the head end of the strip reached the edging rolls. If the temperature drop between the edging rolls and the horizontal rolls is neglected, and the temperature is denoted by $T_{Ro}$ when the strip reached the horizontal rolls, then $T_{Eo}=T_{Ro}$.

Figure 6:
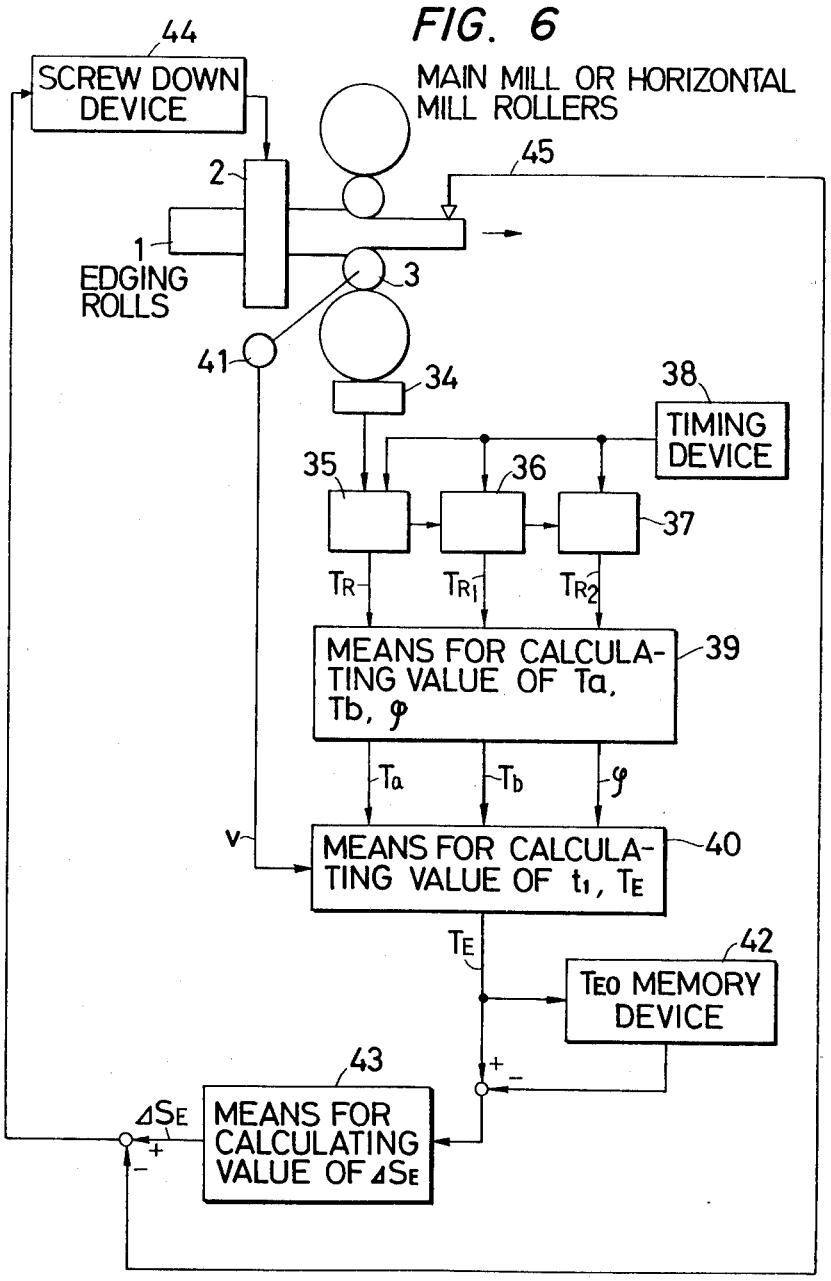
FIG. 6 illustrates an embodiment for controlling the gap of the edging rolls by estimating the temperature of the roll material under the edging rolls from a rolling load of the horizontal rolls.

FIG. 6 shows an embodiment to which is applied the aforesaid method of guessing the strip temperature.

Referring to FIG. 6, the reference numeral 1 represents a strip that is to be rolled, the reference numeral 2 represents edging rolls, the reference numeral 3 stands for horizontal rolls, the reference numeral 34 is a rolling force detector, the reference numeral 35 is an input device to which will be fed the output signals of the rolling force detector 34 to calculate the temperature $T_R$ in accordance with the relation (7), the reference numeral 36 represents a first memory device to memorize the value of rolling force before one sampling, the reference numeral 37 is a second memory device to memorize the value of rolling force before two samplings, and the abovesaid devices 35, 36 and 37 are actuated by a timing generator 38. The reference 39 is an operation device to calculate the aforesaid relations (9), (10), and (11), the reference numeral 40 is a temperature predicting device to predict the temperature $T_E$ from the relations (12), (13) and (14), the reference numeral 41 is a speed detector to detect the rolling speed, the reference numeral 42 stands for a third memory device to memorize the first predicted temperature $T_{Eo}$ of the strip and is commanded by the memory timing generator 38. The reference numeral 43 is a device of calculating the screw-down correcting amount to find the correcting amount $\Delta S_E$ of the rolling opening in accordance with the relation (16) from the difference between the output of the third memory device 42 and the output of the temperature predicting device 40, and the reference numeral 44 is a screw-down device to correct the opening degree of the edging rolls responsive to the sum of the output signals of the device 43 of calculating the screw-down correcting amount and of the device 45 of detecting the width deviation.

After the rolled strip has reached the horizontal rolls 3, the timing generator 38 produces timing pulses after every definite time interval $\tau$ to the input device 35 and to the first and second memory devices 36 and 37. Responsive to the timing command, the second memory device 37 receives the strip temperature from the first memory device 36, and the first memory device 36 receives the strip temperature from the input device 35. The input device 35 detects the rolling force that is measured by the rolling force detector 34, calculates the temperature in accordance with the relation (7) and memorizies it, and produces the memorized value to the operation devide 39. But during the two sampling at the time of starting the rolling, only the data is shifted and no output is produced to the operation device 39. Then using the temperature $T_R$, $T_{R_1}$ and $T_{R_2}$ at three points that were fed, the operation device 39 calculates $Ta$, $Tb$ and $\phi$ in accordance with the relations (9), (10) and (11), to produce the output to the temperature predicting device 40. At this moment, $t_o = 0$ in this embodiment. The temperature predicting device 40 receives $Ta$, $Tb$ and $\phi$ from the operation device 39, and receives the rolling speed from the speed detector 41, to predict the time $t_1$ according to the relation (13) to thereby predict the temperature $T_E$ in accordance with the relation (14). At this moment, $T_E$ represents the temperature of the strip that has reached the horizontal rolls after having been rolled by the edging rolls. The initially calculated value $T_{Eo}$ (e.g., temperature at the head end of the strip) is memorized by the third memory device 42. Thereafter, the devide 43 of calculating the screw-down correcting amount calculates the screw-down correcting amount $\Delta S_E$ depending upon the difference between the memorized value $T_{Eo}$ of the third memory device 42 and the output of the temperature predicting device 40 in accordance with the relation (16), to produce output to the screw-down device 44. Responsive to the output signals of the device of calculating the screw-down correcting amount, the screw-down device 44 moves the positions of the right and left edging rolls 2, 2' by the equal amount, i.e., one-half of $\Delta S_E$ to control the strip width without permitting the center of the strip to be moved. If there is a deviation in width after controlled, the deviation is detected by the width deviation detector 45; the detected signal is added to the output signal of the device of calculating the screw-down correcting amount so that the opening degree of the rolls is corrected.

The foregoing embodiment has dealt with a method of guessing the temperature of the point under the edging rolls by converting the rolling force into the temperature. But the opening degree of the edging rolls may of course be controlled by predicting the rolling force of a point under the edging rolls without converting the rolling force, and by predicting the temperature or the width deviation from the above predicted rolling force. In effect, in this embodiment, the quantity of width control of the strip under the edging rolls is predicted from the rolling force by the horizontal rolls to control the opening degree of the edging rolls, eliminating the fluctuation of width that would be caused by the temperature change of the strip, and hence making it possible to roll the product having a uniform width.

Below is mentioned another embodiment in which the strip temperature is detected by the strip temperature detector provided on the inlet side of the edging rolls to guess the strip temperature under the edging rolls, and the deviation of strip width is found from the relation of FIG. 2 to control the screw-down position of the edging rolls.

If now the value measured by the strip temperature detector is denoted by $\theta$ (° C), and the temperature at the head end of the strip by $\theta_o$ which serve as a reference, the deviation of strip width $b_\theta$, like the relation (4), is given by the relation (17), $$\Delta b_\theta = -m(\theta - \theta_o) + k''_T \tag{17}$$

Figure 7:
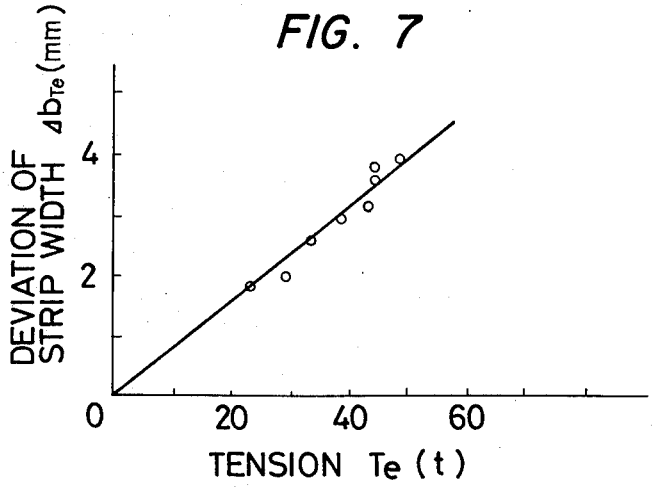
FIG. 7 is a chart illustrating the relationship between the tension and the deviation of strip width.

It has, on the other hand, been known experimentally that the tension between the stands and the change in strip width establish a relation shown in FIG. 7. From FIG. 7, the change in strip width $\Delta b_{Te}$ with respect to the tension $Te$ is given by, $$\Delta b_{Te} = nTe \tag{18}$$

thus changing in proportion to the tension $Te$. Here, $n$ is a constant determined by the relation of FIG. 7.

If viewed from the control system, the width change due to the change of strip temperature, may be regarded to be caused by an external factor, and the change of width due to the change in tension is caused by an internal factor. Therefore, as for the external factors such as temperature, etc., the screw-down position or the speed should be controlled in proportion to the change of factors, and as for the internal factors such as tension, etc., the factors should be held constant. This embodiment effects the control based on its principle to keep the strip width at a determined value. In other words, according to this embodiment, the temperature is detected on the inlet side of the edging rolls to control the screw-down position, and the output torque of the roll driving motor is controlled in inverse proportion to the temperature so that there is developed no tension between the edging rolls and the whole standing mills.

The embodiment is illustrated below in more detail.

Figure 8:
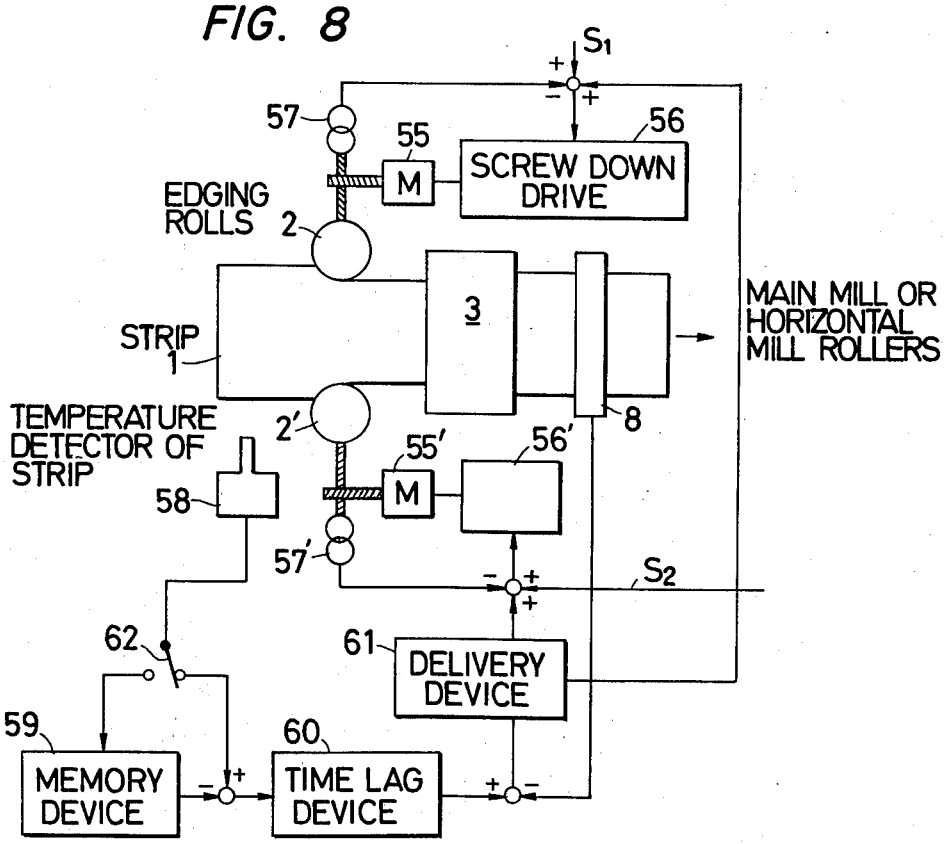
FIG. 8 illustrates an embodiment wherein a temperature detector is disposed on the entry side of the edging rolls for detecting the temperature of the roll material.
Figure 9:
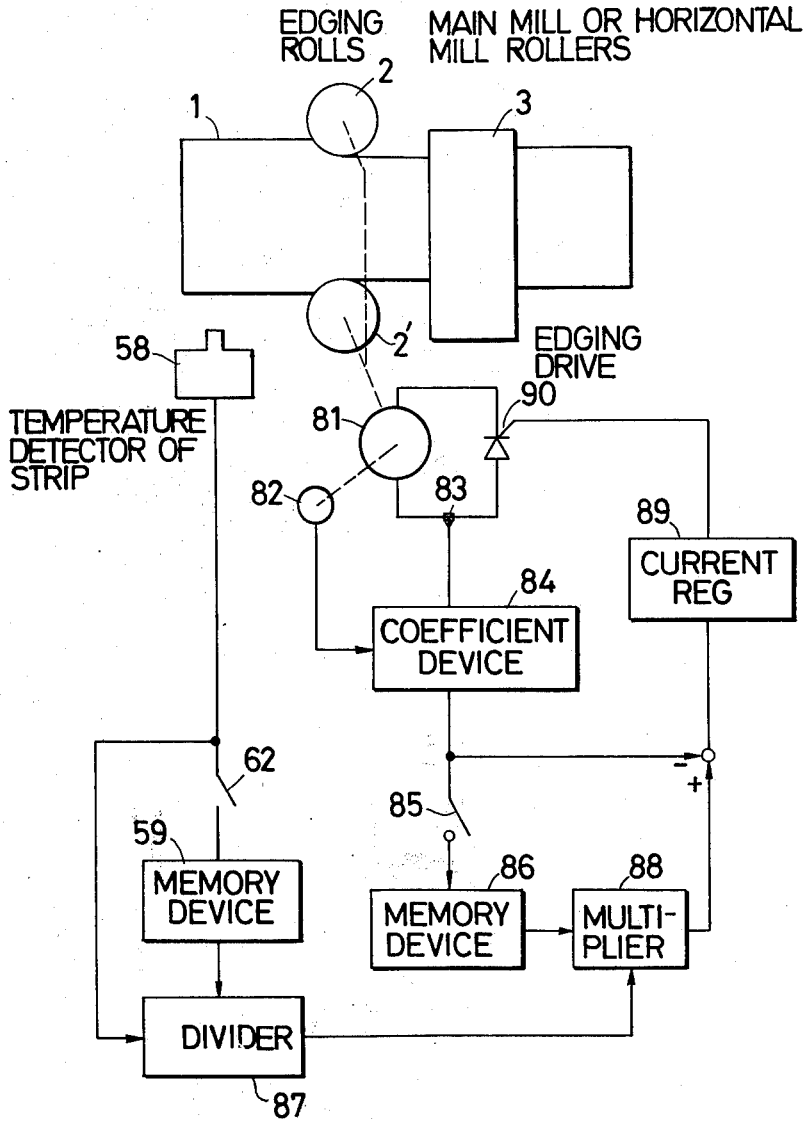
FIG. 9 illustrates another embodiment of FIG. 8.

FIG. 8 shows a screw-down position control system of an embodiment, and FIG. 9 shows a speed control system.

Referring to FIG. 8, the reference numeral is a strip that is to be rolled, the reference numeral 3 stands for horizontal or main mill rolls, the reference numerals, 2, 2' are edging rolls, and the reference numeral 8 stands for a width deviation detector. The reference numeral 55 represents a screw-down motor for determining the positions of the two edging rolls 2, 2', the reference numeral 56 is a positioning device, and the reference numeral 57 represents a screw-down position detector. The reference numeral 58 is a thermometer, the reference numeral 59 is a memory device to memorize the detected temperature at the head end when the head end of the strip reached the thermometer 58, the reference numeral 60 is an operation device that converts the temperature deviation into the screw-down quantity to produce a control quantity lagged behind the running time of the strip 1 between the thermometer and the edging rolls, the reference numeral 61 is a distribution device which distributes the screw-down position changing amount determined by the sum of the output of the operation device 60 and the output signal of the width deviation detector 8 to the screw-down position determining devices of the edging rolls 2, 2'. According to this embodiment, the screw-down position changing amount is distributed qually, establishing a proportional distributor device of a ½ gain. The reference numeral 62 is a changing switch made up of a sensing relay that operates for a certain period of time by the rising signal of the thermometer output that is not shown. During the operation, the switch 62 feeds the output value of the thermometer 58 to the memory device 59, and after a certain period of time has passed, feeds the output of the thermometer 58 to the operation device 60.

If now the strip 1 reaches the position of the thermometer 58 the changing switch 62 is actuated, so that the output signal $\theta$ of the thermometer 58 is memorized as $\theta_o$ by the memory device 59. The memory device 59, thereafter, produces the value $\theta_o$ until the rolling is finished, and the difference signal $\theta - \theta_o$ between said output signal $\theta_o$ and the output signal $\theta$ of the thermometer 50 is fed to the operation device 60. Based on the input signal $\theta - \theta_o$, the operation device 60 calculates the output value $\Delta S_E$ in accordance with the relation (17) and produces the output $\Delta S_E$ lagged behind the time during which the strip 1 reaches the edging rolls 2. To produce the output being lagged behind a certain time, can be effected by a conventional analog or digital means. The output $\Delta S_E$ is fed into a distributor 61, and a signal one-half of $\Delta S_E$ is fed to the screw-down position determining device 56 which actuates the motor based on the signal of the sum of setpoints of $S_1$, $S_2$ and one-half of $\Delta S_E$, to correct the screw-down position. The aforesaid operation is repeated thereafter until the rolling is finished.

Next, the speed of the motor is controlled in the following way.

The load torque $G_E$ applied to the motor during the rolling operation can be expressed by the following relation (19), $$G_E = G_{Eo} - R \cdot Te \tag{19}$$

where R is a redius of the vertical rolls, and *Te* is tension.

Here, $G_{Eo}$ represents a load torque under the condition of no tension, and can be detected when the strip 1 is being rolled by the edging rolls prior to reaching the horizontal or main mill rolls 3.

Therefore, the tension T*e* will not be produced if the output torque of the edging roll driving motor is so controlled as to be in conformity with the load torque $G_{Eo}$. But the load torque $G_{Eo}$ tends to be changed under the state of no tension, with the change of the strip temperature, Therefore, in this embodiment, the load torque $G_{Eo}$ is corrected by the temperature $\theta$, and the torque $G_E$ of the motor during the rolling operation is so controlled as will be given by the following relation (20)

$$G_E = G_{Eo} \cdot \frac{\theta_o}{\theta} \tag{20}$$

FIG. 9 shows an embodiment of controlling the abovesaid control, and the same numerals represent the same parts as those of FIG. 8. The reference numeral 81 stands for a roll driving motor, the reference numeral 82 stands for a speed detector to detect the revolving speed of the motor, the reference numeral 83 is a current detector, the reference numeral 84 stands for a coefficient device that will be corrected by the output signals of the speed detector 82 to multiply the current I with a coefficient $\xi\phi$ so that it is converted into torque. That is, there holds, $$\left.\begin{aligned} G_E &= \xi\,\phi \cdot I \\ \xi\,\phi &= \xi\phi_o\,(\omega \leqq \omega_B) \\ G_E &= \xi\,\phi_o \frac{\omega_B}{\omega}\,(\omega > \omega_B) \end{aligned}\right\} \tag{21}$$

where $\xi\phi o$ is a coefficient of torque conversion at a base speed $\omega_s$, and $\omega$ is an angular velocity of the motor.

The reference numeral 85 stands for a changing switch that closes after a certain period has passed after the strip 1 had reached the edging rolls 2, 2', the reference numeral 86 is a memory device which receives the motor torque $G_E$ which is an output signal of the coefficient device 84 while the changing switch 62 is being closed. The memory device 84 memorizes the motor torque as a reference value $G_{Eo}$. The reference numeral 87 is a divider that calculates the ratio $\theta_o/\theta$ of the output of the thermometer 58 and the output of the memory 59 to produce an output lagged behind a running time of the strip, the reference numeral 88 represents a multiplier that operates the product of the output signal of the divider 87 and the output signal of the memory device 86, and the reference numeral 89 stands for a current regulator which controls the igniting timing of a thyristor means 90 responsive to the difference of torque $G_E - G_{Eo}$, in order to control the current that flows in the motor.

During the operation, as the strip 1 to be rolled reaches the thermometer 58, the changing switch 62 is operated so that the memory deivce 59 memorizes the temperature $\theta_o$. Thereafter, the divider 87 produces a signal of the ratio $\theta_o/\theta$. Then, as the strip 1 reaches the edging rolls 2, 2', the changing switch 85 is actuated, and the torque $G_E$ is memorized as $G_{Eo}$ by the memory device 86. Thereafter, until the rolling is finished, the product of the output signal of the memory device 86 and the output signal of the devider 87 is calculated by the multiplier 88; the output value serves as a reference value $G_E$ of controlling the torque. The reference value $G_E$ is compared with the output value of the coefficient device 84. And if there is any deviation, the current regulator 89 controls the current through the thyristor means.

In this way, the strip 1 is controlled to develop no tension and invites no variation in width that would be caused by the internal factors.

In short, with this embodiment, the strip temperature is measured at the inlet side of the edging rolls to control the screw-down position and the motor current responsive to the change of amount. Therefore, not only the change in width due to the temperature change is controlled but also there is developed no tension between the edging rolls and the horizontal or main mill rolls, while at the same time, greatly enhancing the precision of width and yield.

As for the values measured by the thermometer 58, the above embodiment took into account only the time lag until the measured point reaches the edging rolls. But more precise strip temperatures can be guessed if the strip temperature under the edging rolls is predicted by taking into consideration the values of temperature drop over the distance that are empirically found. It will also be considered easily from the embodiment of the present invention to establish a relation between the strip surface temperature and the temperature in the strip with respect to the values measured by the thermometer 58 and to employ more accurate values of postulated temperatures reinforced with further corrections.

In the foregoing were mentioned three concrete embodiments of the present invention, to predict the strip temperature under the edging rolls from the load of the horizontal rolls, or to predict the strip temperature under the edging rolls from the values measured by the strip temperature detector that is installed on the inlet side of the edging rolls. But the present invention is not necessarily limited to these embodiments only, but encompasses various other modifications to control the opening degree of the edging rolls for the purpose of controlling the strip width to be constant, by guessing the strip temperature under the edging rolls by any other appropriate means and by utilizing the relationship between the strip temperature and the deviation of the strip width.

What is claimed is:

1. A method of automatic width control of hot rolled strip comprising guessing the temperature of a strip under edging rolls, adjusting the roll position of said edging rolls based on the relation between the strip temperature and the deviation of the strip width, and controlling the strip width to be a certain determined width.

2. A method of automatic width control of hot rolled strip according to claim 1, wherein the change of load of the edging rolls is detected, the strip temperature under the edging rolls is guessed from the deviation from the reference load, and the roll position of the edging rolls is adjusted based on said guessed temperature in order that the width of the strip is controlled to be a certain determined width.

3. A method of automatic width control of hot rolled strip according to claim 1, wherein there are provided edging rolls which control the strip width, horizontal rolls which obtain the desired strip thickness, and a horizontal roll load detector to detect the change of load of the horizontal rolls, and wherein the load of horizontal rolls is detected, the strip temperature is guessed from the difference between said detected load and the reference load, the change of said temperature with passage of time is approximated by the periodical function based on the relation between the rolling speed and the length of the skidding mark, the strip temperature under the edging rolls is guessed from the relative positions of said edging rolls and the horizontal rolls, the deviation of strip width is calculated from said guessed temperature, the roll position of the edging rolls is changed by way of a device of controlling the screw-down position of the edging rolls, in order to control the strip width to be a certain determined width.

4. A method of automatic width control of hot rolled strip according to claim 1, wherein the relation between the strip temperature and the deviation of the strip width is approximated by a linear equation of a proportional coefficient, and the deviation of the strip width is calculated based on said approximation in order to control the roll position of the edging rolls responsive to the deviation of the strip width.

5. A method of automatic width control of hot rolled strip according to claim 4 in which the relation between the strip temperature and the deviation of the strip width is approximated by a linear equation, wherein the proportional coefficients and constants are determined depending upon the kind of steels, and the roll position of the edging rolls is changed utilizing the approximate relation between the strip temperature and the deviation of the strip width specific to the steel, in order to control the strip width to be a certain determined width.

6. A method of automatic width control of hot rolled strip according to claim 1, wherein the edging rolls between which is rolled the strip, are opened one-half of its full roll gap as found from the relation between the strip temperature and the deviation of the strip width, and the opening speed of the two vertical rolls is controlled to be equal, to thereby control the width of the strip.

7. A method of automatic width control of hot rolled strip according to claim 2, wherein a reference load to which will be compared the detected load of the edging rolls, is utilized as a load to be exerted on the head one of the strip, and said reference load is compared with the subsequent loads to calculate the signals of controlling the roll position of the edging rolls based on said comparative signals.

8. A method of automatic width control of hot rolled strip according to claim 3, wherein a reference load to which will be compared the detected load of the horizontal rolls, is utilized as a load to be exerted on the head end of the strip, and said reference load is compared with the subsequent loads to utilize the comparative signals as signals of controlling the roll position of the edging rolls.

9. A method of automatic width control of hot rolled strip according to claim 2, wherein the roll position of the edging rolls is controlled responsive to the differential signals between the signals of controlling the roll position of the edging rolls guessed from the strip temperature under the edging rolls and the signals from the strip width deviation detector that is installed on the downstream of the edging rolls.

10. A method of automatic width control of hot rolled strip according to claim 3, wherein the roll position of the edging rolls is controlled responsive to the differential signals between the signals of controlling the roll position of the edging rolls found from the strip temperature under the edging rolls as guessed from the load by the horizontal rolls and the signals produced from the strip width deviation detector that is installed on the downstream of said horizontal rolls.

11. A method of automatic width control of hot rolled strip according to claim 3, wherein the temperature drop over the distance of the edging rolls and the horizontal rolls is taken into account as a certain value proportional to the distance in addition to guessing the strip temperature under the edging rolls using a periodic function, and correction is effected to the strip temperature under the edging rolls utilizing said certain value.

12. A method of automatic width control of hot rolled strip according to claim 3 in which the strip temperature under the edging rolls is approximated by a periodic function, wherein an angular frequency $\omega$ of said periodic function is expressed as $\omega = V_R/L$ from the relation between a predetermined skidding mark length L and the rolling speed $V_R$, to thereby guess the strip temperature under the edging rolls.

13. A method of automatic width control of hot rolled strip according to claim 3 in which the strip temperature under the edging rolls is guessed by an approximated periodic function, wherein if the sampling period is denoted by $\tau$ and the present time by $t_o$ in said periodic function, the strip temperature under the edging rolls after the time $t_o + \tau$ is guessed from at least three points $t_o, t - \tau$, and $t_o - 2\tau$.

14. A method of automatic width control of hot rolled strip equipped with edging rolls, wherein the strip temperature is detected by a strip temperature detector that is provided on the inlet side of said edging rolls, the strip temperature under the edging rolls is guessed by taking into consideration the time lag after which the point of measuring the strip temperature reaches the edging rolls as determined by the rolling speed, the deviation of strip width is found from a linear approximation that states a certain definite relation between the strip temperature and the deviation of the strip width, and the roll position of the edging rolls is adjusted responsive to said deviation of strip width to control the strip width to be a certain determined width.

15. A method of automatic width control of hot rolled strip according to claim 14, wherein the strip temperature is detected by a strip temperature detector that is provided on the inlet side of the edging rolls, the drop of strip temperature between said strip temperature detector and said edging rolls is stated in terms of a certain determined value proportional to the distance between said two, the drop of said temperature is guessed by taking into consideration the time lag after which the strip reaches the edging rolls depending upon the rolling speed, and the strip temperature under the edging rolls is guessed.

16. A method of automatic width control of hot rolled strip according to claim 14, wherein the roll position of the edging rolls is controlled based on the differential signals between the signals of controlling roll position of the edging rolls as guessed from the strip temperature under the edging rolls and the signals produced by the strip width deviation detector that is provided on the downstream of said edging rolls.

17. A method of automatic width control of hot rolled strip according to claim 1, wherein the output torque of a motor for driving the edging rolls is controlled by the control signals that are inversely proportional to the guessed strip temperature.

* * * * *